US007726410B2

(12) United States Patent
Wagner

(10) Patent No.: US 7,726,410 B2
(45) Date of Patent: Jun. 1, 2010

(54) MULTI-STAGE INERTIZATION PROCESS FOR PREVENTING AND EXTINGUISHING FIRES WITHIN ENCLOSED SPACES

(75) Inventor: Ernst-Werner Wagner, Winsen/Aller (DE)

(73) Assignee: Amrona AG, Zug (CH)

( * ) Notice: Subject to any disclaimer, the term of this patent is extended or adjusted under 35 U.S.C. 154(b) by 303 days.

(21) Appl. No.: 11/870,871

(22) Filed: Oct. 11, 2007

(65) Prior Publication Data

US 2008/0087445 A1 Apr. 17, 2008

(30) Foreign Application Priority Data

Oct. 11, 2006 (EP) ..... 06122142

(51) Int. Cl.

| | |
|---|---|
| ***A62C 2/00*** | (2006.01) |
| ***A62C 2/24*** | (2006.01) |
| ***A62C 3/00*** | (2006.01) |
| ***A62C 35/00*** | (2006.01) |
| ***A62C 37/00*** | (2006.01) |
| ***A62C 37/36*** | (2006.01) |

(52) U.S. Cl. ..... 169/45; 169/11; 169/46; 169/60; 169/61

(58) Field of Classification Search ..... 169/5, 169/11, 43, 45, 46, 54, 56, 60, 61

See application file for complete search history.

(56) References Cited

U.S. PATENT DOCUMENTS

| | | | | |
|---|---|---|---|---|
| 6,676,081 | B2 * | 1/2004 | Grabow et al. | 244/129.2 |
| 6,739,399 | B2 * | 5/2004 | Wagner et al. | 169/45 |
| 2002/0023762 | A1 * | 2/2002 | Kotliar | 169/54 |
| 2007/0169947 | A1 * | 7/2007 | Love | 169/45 |

FOREIGN PATENT DOCUMENTS

| | | | |
|---|---|---|---|
| DE | 198 11 851 | A1 | 9/1999 |
| EP | 1 550 481 | A | 7/2005 |
| EP | 1 550 482 | A | 7/2005 |

* cited by examiner

*Primary Examiner*—Darren W Gorman
(74) *Attorney, Agent, or Firm*—Fraser Clemens Martin & Miller LLC; J. Douglas Miller

(57) ABSTRACT

The present invention relates to an inertization process for decreasing a risk of fire and for extinguishing fires in a protected room, wherein an oxygen concentration in the protected room is first lowered to a specific base inertization level, and wherein the oxygen concentration in the protected room is maintained at the base inertization level. In the event of a fire, additional inert gas is introduced based upon the extent of the fire in the protected room to further decrease from the base inertization level to a first lowered level. The oxygen concentration is maintained at the first lowered level for a first preset time interval, and further decreased from the first lowered level to a full inertization level, if the fire has not yet been extinguished once the first preset time interval has elapsed.

20 Claims, 3 Drawing Sheets

MULTI-STAGE INERTIZATION PROCESS FOR PREVENTING AND EXTINGUISHING FIRES WITHIN ENCLOSED SPACES

CROSS REFERENCE TO RELATED APPLICATION

This application claims the benefit of European Application 06122142.0 filed on Oct. 11, 2006, the disclosure of which is hereby incorporated herein by reference, in its entirety.

FIELD OF THE INVENTION

The present invention relates to an inertization process for reducing the risk of fire and for extinguishing fires inside a protected room, whereby the oxygen concentration inside the protected room is first decreased to a specific base inertization level, and whereby the oxygen concentration inside the protected room is then maintained continuously at the base inertization level.

BACKGROUND OF THE INVENTION

This type of inertization process is known in principle from the prior art. For example, German Patent Specification DE 198 11 851 C2 describes an inertization device for decreasing the risk of fire and for extinguishing fires in enclosed spaces, and a device for implementing said process. This prior art provides for the oxygen concentration inside an enclosed space (hereinafter called "protected room") to be lowered to a specific base inertization level, and in the event of a fire for the oxygen concentration to be rapidly further decreased to a specific full inertization level, thereby enabling an effective extinguishing of a fire with the smallest possible storage capacity for inert gas tanks.

This inertization process is based upon the knowledge that inside enclosed spaces which humans and animals enter only occasionally, and in which the equipment reacts sensitively to the effects of water, the risk of fire can be countered by lowering the oxygen concentration in the relevant area to a level averaging approximately 12 vol.-%. At this oxygen concentration, most combustible materials can no longer burn. The main areas of application include especially ADP areas, electrical switching and distribution spaces, enclosed facilities, and storage areas containing high-value commercial goods.

The extinguishing effect resulting from this process is based upon the principle of oxygen displacement. As is known, normal environmental air is made up of 21 vol.-% oxygen, 78 vol.-% nitrogen and 1 vol.-% other gases. To extinguish a fire, the nitrogen concentration in the relevant space is further increased by introducing nitrogen, thereby decreasing the oxygen ratio. It is known that an extinguishing effect is initiated when the oxygen ratio drops below 15 vol.-%. Depending upon the combustible materials present in the protected room, a further drop in the oxygen ratio, for example to 12 vol.-%, may be necessary.

The term "base inertization level" used herein refers to an oxygen concentration that is reduced as compared with the oxygen concentration of the normal ambient air; however this reduced oxygen concentration presents no danger of any kind to persons or animals, so that these are still able to enter the protected room without problems. The base inertization level corresponds to an oxygen concentration inside the protected room of, for example, 15 vol.-%, 16 vol.-%, or 17 vol.-%.

In contrast, the term "full inertization level" refers to an oxygen concentration that is reduced further as compared with the oxygen concentration of the base inertization level, in which the flammability of most materials is already decreased so far, that they are no longer capable of igniting. Depending upon the fire load inside the protected room, the full inertization level generally ranges from 11 vol.-% to 12 vol.-% oxygen concentration.

In the "inert gas extinguishing technique" known from DE 198 11 851 C2, which refers to the flooding of a space that is prone to fire or is on fire with oxygen-displacing gases, such as carbon dioxide, nitrogen, noble gases and mixtures of these, the oxygen concentration inside the protected room is first lowered to a specific base inertization level of, for example, 16 vol.-%, and in the event of a fire is further lowered to a specific full inertization level of, for example, 12 vol.-% or lower. By using this two-stage inert gas process, in which first the base inertization level is established to reduce the risk of fire, and in which enough nitrogen is supplied, as needed, in an additional introduction of inert gas to extinguish a fire, until the full inertization level has been established, the result is that the number of tanks needed for the oxygen-displacing inert gases required in the event of a fire can be kept as small as possible. Especially, with this inertization process known from the prior art, the need to provide a relatively large storage capacity for inert gas tanks in order to be able to establish a full inertization level inside the protected room in the event of a fire is eliminated.

However, in the practical application of this known process, it has been found problematic, that with the inertization process in the event of a fire, in other words when a characteristic fire value has been detected in the atmosphere inside the protected room, the oxygen concentration inside the protected room must be lowered very rapidly to the specific full inertization level. This is accomplished by introducing the necessary volume of gas within a very short time into the protected room in the event of a fire, in order to effectively contribute to extinguishing the fire. Although the known and above-described process largely solves the problem of storing the inert gas tanks required to establish the full inertization level, it has nonetheless been found problematic that in establishing the full inertization level within the shortest period of time, a volume (although reduced) of inert gas must be introduced into the protected room, which frequently cannot be accomplished considering the necessary decompression of the protected room. The inflow of the reduced gas volume to establish the full inertization level is found to be especially problematic in protected rooms in which no structural decompression is provided.

Furthermore, the above-described prior art provides that, in the event of a fire, the oxygen concentration inside the protected room is lowered to the full inertization level, independent of the size of the fire and/or the type of fire, by releasing the total quantity of recommended extinguishing agent. In particular, with the prior art, no differentiation is given as to what stage the fire is in. Thus the full inertization level is established regardless of, whether, for example, a deep glowing fire is present or only a low-temperature fire, or what materials first ignited inside the protected room. For example, if only solids ignited inside the protected room, a full inertization of the protected room to approximately 14 vol.-% oxygen to combat the fire would be sufficient to effectively prevent an ignition of the solid, since the ignition threshold for solids lies at approximately 15 vol.-% oxygen. If, however, combustible fluids, which are known to have an ignition threshold below 15 vol.-%, caught fire inside the protected room, then full inertization for fighting the fire must be implemented to the aforementioned 12 vol.-% oxygen or lower.

With the known process, however, in principle a full inertization to, for example, the aforementioned 11 vol.-% oxygen is performed—regardless of the ignition threshold of the materials burning inside the protected room, so that under certain circumstances significantly more inert gas is supplied to the protected room than would be necessary to fight the fire.

SUMMARY OF THE INVENTION

Beginning with this problem formulation, the object of the present invention is now to further develop the inertization process for reducing the risk of fire and for extinguishing fires inside protected rooms, known from DE 198 11 851 C2 and described above, such that no specially provided decompression is required to apply the process inside the protected room, and to ensure at the same time, that, in the event of a fire, the additional quantity of inert gas which is introduced to fight the fire can be based upon the extent of the fire, thereby permitting a savings of inert gas, and structuring the inertization process to be more cost-effective.

This object is attained with the inertization process mentioned at the beginning in that, in the event of a fire inside the protected room, the oxygen concentration is first lowered further from the base inertization level to a first lowered level, the oxygen concentration is continuously maintained for a first preset time interval at this first lowered level, and in that, if the fire has not yet been extinguished when the first preset time has elapsed, the oxygen concentration is further lowered from the first lowered level to the full inertization level.

The advantages of the process of the invention consist especially in that—in addition to the advantage of the smaller storage capacity for inert gas tanks already known from the prior art—in the event of a fire, a lower volume of gas is introduced into the protected room, so that it is no longer necessary to provide for structural decompression inside the protected room. Thus decompression openings in the protected room can be entirely eliminated. In other words, this means that with the solution of the invention, the inertization process can be used to fight fires in spaces of nearly any size, especially without special decompression openings having to be provided within these spatial dimensions.

The first lowered level is selected such that it lies between the base inertization level, at which, to minimize the risk that a fire will start inside the protected room, the oxygen concentration inside the protected room is already reduced as compared with the oxygen concentration in the normal atmosphere, and the full inertization level, at which the flammability of the materials present inside the protected room is reduced to the point at which these can no longer ignite.

In this regard, it should be mentioned that the base inertization level, which is established inside the protected room in advance, in other words before the detection of a fire, can correspond to any oxygen concentration that is reduced as compared with the oxygen concentration of the normal atmosphere, at which a free passage into the protected room is still possible. This base inertization level can, of course, also correspond to an oxygen concentration which is different from the initially described 15 vol.-%. As the base inertization level, it would be conceivable, for example, to establish an oxygen concentration inside the protected room of 17 vol.-%, if this is necessary in an individual case.

However, because from a medical standpoint, in adhering to specific guidelines, spending time in areas having a reduced-oxygen surrounding atmosphere (at approximately 1 bar absolute environmental pressure) up to an oxygen concentration of 13 vol.-% is safe, it would naturally also be conceivable to establish a base inertization level of, for example, 14 vol.-% or 13.5 vol.-% in the implementation of the inertization process of the invention.

What is important is that, with the inertization process of the invention, after the oxygen concentration has been lowered to the specific base inertization level, the oxygen concentration is also continuously maintained at this base inertization level. This is accomplished, for example, via a regular or continuous measurement of the oxygen concentration inside the protected room, and via a controlled introduction of inert gas into the protected room, in order to maintain the oxygen concentration at the base inertization level. Of course, it is also conceivable in this case, in addition to the controlled introduction of inert gas to maintain the base inertization level, for fresh air to also be introduced in a controlled manner into the protected room, in order to prevent, for example, the oxygen concentration from dropping below the base inertization level as a result of an introduction of an excessive quantity of inert gas.

An expert will recognize that the term "maintaining the oxygen concentration at a specific inertization level" used herein refers to maintaining the oxygen concentration at the inertization level with a specific control range, whereby said control range can preferably be selected based upon the type of protected room (for example based upon an air exchange rate that applies to the protected room or based upon the materials stored inside the protected room) and/or based upon the type of inertization system used, with which the process of the invention is implemented. Typically, this type of control range lies at 0.1 to 0.4 vol.-%. Of course, other control ranges are also conceivable.

In addition to the aforementioned continuous and/or regular measurement of the oxygen concentration, however, the oxygen concentration can also be maintained at the specific inertization level based upon a calculation performed in advance, whereby in this calculation, certain structural parameters for the protected room are utilized, such as, for example, the air exchange rate that is valid for the protected room, especially the n50 value for the protected room, and/or the pressure difference between the protected room and the ambient air.

With respect to the full inertization level, which in the inertization process of the invention is established when the fire has still not been extinguished after the first preset time interval has elapsed, it is noted, that this full inertization level corresponds to an oxygen concentration at which a fire can be effectively extinguished inside the protected room via oxygen displacement. In this, the full inertization level is selected in advance based upon the fire load of the protected room, and corresponds, for example, to an oxygen concentration of 11 or 12 vol.-% or lower. Especially for protected rooms in which readily flammable liquid materials are stored, under certain circumstances an even lower oxygen concentration should be selected for the full inertization level specific to the protected room.

The process of the invention is characterized especially in that, in the event of a fire, the oxygen concentration inside the protected room is decreased from the previously established base inertization level to the first lowered level. The decrease to the first lowered level is implemented, for example, based upon a corresponding signal from a fire detection device, configured to detect a characteristic fire value in the air inside the protected room.

The term "characteristic fire value" refers to physical values upon which measurable changes in the air surrounding a starting fire are based, for example the surrounding temperature, the solid or liquid or gas ratio in the ambient air (formation of smoke in the form of particles of aerosols or vapor) or the surrounding radiation. For example, with the inertization process of the invention, especially once the oxygen concentration has been reduced to the base inertization level, representative air samples are continuously taken via an aspiration-type fire detection system from the air inside the protected room to be monitored, and are fed to a detector for detecting characteristic fire values, which in the event of a fire emits a corresponding signal to a control unit which controls the inertization process for establishing the first lowered level. This involves a process-technology conversion of the connection of a known aspiration-type fire detection device with the inert gas extinguishing technology, which is based upon the inertization process of the invention.

In this regard, an aspiration-type fire detection device is a fire detection device that suctions up a representative partial quantity of the air inside the protected room to be monitored, for example via a pipe or channel system, at a multitude of points inside the protected room, and then feeds this partial quantity to a measuring chamber containing the detector for the purpose of detecting a characteristic fire value. It would especially be conceivable for this detector to be configured to detect a characteristic fire value so as to emit a signal, which also enables a quantitative assessment with respect to the characteristic fire values present in the suctioned partial quantity of room air. With this it would be possible to detect the course of the fire over time and/or the course of the development of the fire over time, in order to determine the effectiveness of the establishment and maintenance of the different inertization levels inside the protected room. Especially, it would be thus possible to obtain a statement as to what quantity of inert gas must still be supplied to the protected room to extinguish the fire.

Once the oxygen concentration has been reduced from the base inertization level to the first lowered level, the oxygen concentration is maintained continuously at this first lowered level for a first preset time interval. This first preset time interval is advantageously selected based upon the protected room, based upon the fire load stored inside the protected room, and/or based upon other parameters, and amounts, for example, to 10 minutes.

In particular, the first preset time interval should be a time interval that is long enough to reach an adequately precise conclusion as to whether the decrease in the oxygen concentration from the base inertization level to the first lowered level has resulted in an extinguishing of the fire inside the protected room. On the other hand, the first preset time interval should be sufficiently short to prevent further damage caused by the delayed establishment of the full inertization level inside the protected room by the fire that has started there.

Whether or not the fire in the protected room has been extinguished after the first preset time has elapsed can be determined, for example, by a preferably quantitative measurement of at least one characteristic fire value in an actively suctioned representative partial quantity of the room air. Of course, however, other processes are also conceivable with which it can be determined, whether the fire in the protected room has been extinguished once the first preset time interval has elapsed.

Advantageous further developments of the process of the invention are disclosed in the sub-claims.

Thus with a particularly preferred implementation of the inertization process of the invention, it is provided, that the oxygen concentration inside the protected room is further decreased from the first lowered level to a second lowered level, which is different from the full inertization level, and is maintained continuously at this second lowered level for a second preset time, if the fire still has not been extinguished when the first preset time interval has elapsed, whereby, if the fire still has not been extinguished when the second preset time interval has elapsed, the oxygen concentration of the second lowered level is lowered further to the full inertization level.

The second lowered level of this preferred further development of the inertization process of the invention advantageously lies between the first lowered level and the full inertization level and is—like the first lowered level—selected based upon the protected room and based upon the fire load which is stored inside the protected room. Of course it is also conceivable, however, for the first and/or the second lowered level to be selected based upon the technical implementation of an inertization system that is provided for implementing the inertization process of the invention.

The advantage of this preferred further improvement is obvious: By introducing an additional lowered level between the first lowered level and the full inertization level, it is possible to adapt the inertization process even more precisely to the protected room to be monitored. Especially with this, in the event of a fire, the lowering from the base inertization level to the full inertization level is implemented via two intermediate lowered levels, whereby the problem described at the start is defused even further with respect to the necessary decompression inside the protected room.

Because the oxygen content inside the protected room is also maintained at the second lowered level for a second preset time interval, the quantity of gas that is necessary for the ultimate and effective extinguishing of the fire can also be more precisely adjusted. Thus it is conceivable, for example, that the fire may not be completely extinguished when the first preset time interval has elapsed, because inside the protected room materials have caught on fire, the critical ignition thresholds of which still lie below the oxygen concentration that corresponds to the first lowered level. Because the oxygen concentration that corresponds to the second lowered level is below the oxygen concentration of the first lowered level, by adjusting and maintaining the oxygen concentration at the second lowered level for the second preset time interval, a fire involving materials whose critical ignition threshold lies below the first lowered level but above the second lowered level can also be extinguished. In other words, this means that, in such cases a fire can be effectively extinguished without the oxygen concentration inside the protected room having to be decreased to the full inertization level. In this regard, it must be recognized, that in the selection of the first and the second lowered levels, the fire load which is present inside the protected room to be monitored can play a major role.

With respect to the second preset time interval during which the oxygen concentration inside the protected room is maintained at the second lowered level, essentially what was stated above in connection with the first preset time interval also applies.

In order to permit a fire that has broken out inside the protected room to be effectively extinguished using the inertization process of the invention, even if the reduction in the oxygen concentration from the base inertization level to the full inertization level is implemented over multiple lowered levels, it is provided in one preferred further improvement, that the full inertization level is continuously maintained inside the protected room until the fire is completely extinguished. The occurrence of the complete extinguishing of the fire inside the protected room is preferably again recognized via a corresponding detector for detecting characteristic fire values. An aspiration-type fire detection device is also recommended for this, as was already described above. Of course, with respect to maintaining the oxygen concentration at the full inertization level, it is also conceivable for the oxygen concentration inside the protected room to temporarily lie significantly below the oxygen concentration that is critical for the full inertization level. The lower limit of the control range, within which the oxygen concentration is to be controlled to maintain the full inertization level, can assume any lower value. Of course, to detect the occurrence of the complete extinguishing of the fire inside the protected room, another process, for example an optical process, can be used. It would also be conceivable for the full inertization level to be maintained inside the protected room until a manual release, for example, of forces that have, for example, already been determined.

In another preferred further development of the inertization process of the invention it is provided, that, once the first and/or the second preset time interval has elapsed, the oxygen concentration inside the protected room is again raised to the inertization level, when the fire inside the protected room has been extinguished following the elapse of the first or the second preset time interval. This involves a further process technology development, with which only that quantity of gas that is necessary to extinguish the fire is introduced into the protected room, whereby especially the inertization level is reduced gradually until the fire has been extinguished, and whereby once the fire has been extinguished, no further reduction in the oxygen concentration, for example to the second lowered level or to the full inertization level, occurs. In this manner, inert gas can especially be saved.

With the latter further improvement on the inertization process, it is most especially preferable for the oxygen concentration inside the protected room to be raised the base inertization level following the elapse of the first or the second preset time interval, based upon a further, preferably manual release. Because this additional release can especially be independent of the inertization system executing the inertization process of the invention, increased safety in terms of system disruptions or errors is achieved with this preferred implementation. Of course, the additional release can also be automatically implemented on the basis of a separate device for detecting a characteristic fire value inside the protected room.

With the inertization process according to the invention, and with its described further improvements, it is especially preferred, that the first lowered level, which corresponds to an oxygen concentration that is further reduced as compared with the oxygen concentration of the base inertization level, is selected based upon an oxygen concentration that corresponds to the ignition threshold of the fire loads present inside the protected room. At this point it is noted, that the ignition threshold of a given material may be somewhat higher than its extinguishing threshold.

In this, the ignition threshold for a material is determined in a preferred manner in advance through testing, using a VdS failure prevention testing procedure which is as close as possible to reality and that can be reproduced, if this value is unknown for materials or objects. In a test of this type, the solids to be tested are ignited with an ignition source at an oxygen concentration of 20.9 vol.-%. The time interval required for this is measured. The oxygen concentration is then lowered with defined ambient conditions over the course of multiple tests, until the ignition source is able to act upon the material for twice the time interval without igniting it. In this, especially the following values are determined and/or established: Oxygen concentration of the testing atmosphere; temperature during the test; wind speed inside the testing room; duration of ignition; flame temperature; and air humidity inside the testing room. In the determination of a corresponding value for a liquid, it is especially important also to determine and to take into account the air pressure and the temperature of the liquid and the ambient air. To determine the extinguishing threshold, the material is ignited in normal air at an oxygen concentration of 20.9 vol.-%. The oxygen concentration is then slowly reduced until the fire is extinguished.

For electrical risks, for example, the ignition threshold is an oxygen concentration of 15.9 vol.-%, whereas the extinguishing threshold corresponds to an oxygen concentration of 15.5 vol.-%. Of course, in establishing the oxygen concentration that corresponds to the first lowered level; it is also or alternatively conceivable to take other parameters into account.

With respect to the second lowered level, which corresponds to an oxygen concentration that is reduced further as compared with the oxygen concentration of the first lowered level, it is advantageously provided, that this second level is selected from an oxygen concentration which corresponds to the extinguishing threshold of the fire loads present inside the protected room. In this regard, it is conceivable for the second lowered level to lie below the oxygen concentration that corresponds to the extinguishing threshold of the fire loads present inside the protected room. Of course, the second lowered level can also be determined in advance taking other aspects into account.

For the technical implementation of the inertization process according to the invention, and the above-described preferred further improvements, it is provided, that at least one characteristic fire value is measured continuously inside the protected room, in order to determine whether there is a fire inside the protected room and/or whether the fire inside the protected room has already been extinguished. However, the measurement of the characteristic fire value need not be continuous, rather it is also conceivable for this type of measurement to be taken at predetermined time intervals and/or based upon specific, predetermined events. The measurement of the characteristic fire value is preferably performed using a detector for determining characteristic fire values, which in the event of a fire emits a corresponding signal for additional inertization. For example, samples that are representative of the air inside the room to be monitored are taken, and are fed to the detector for characteristic fire values.

On the other hand, it would also be conceivable for multiple different characteristic fire values to be measured, preferably continuously, inside the protected room, in order to determine what combustible materials are burning inside the protected room. In this, the knowledge is utilized, that each combustible material releases characteristic fire values in burning. These characteristic fire values can thus be utilized, in order to reach conclusions regarding the type of combustible good that is burning, which in the event of a fire supplies important benefits for effectively fighting the fire and, if applicable, for safety measures to be instated, especially with respect to a rapid, effective and environmentally friendly fighting of the fire.

With the latter embodiment, it is especially preferred that, based upon the ignition and/or extinguishing threshold value of the determined combustible good, the first and/or the second lowered level are/is selected. Accordingly, it is possible to adjust the inert gas extinguishing technique that is used in an optimal manner to the individual case, and especially to the combustible good that is burning, whereby it is possible, in the event of a fire, that the quantity of inert gas to be additionally introduced into the protected room and used to fight the fire can be adapted very precisely to the extent and the nature of the fire.

As was already mentioned, the detector is preferably configured to supply quantitative information with regard to the detected characteristic fire values, in order thereby to monitor the course over time of the fire inside the protected room to be monitored, and to be able to initiate appropriate measures for establishing the different oxygen level. In this, it would be conceivable for the entire inertization process, including the detector for determining the characteristic fire value and including a control unit for evaluating the signals emitted by the detector, to run fully automatically or at least partially automatically, in order thereby to provide the most autonomous and, to a certain extent, intelligent inertization process possible for reducing the risk of fire and extinguishing fires inside the protected room.

In a particularly preferred implementation of the latter embodiment, in which at least one characteristic fire value is measured inside the protected room, in order to determine whether a fire is burning inside the protected room, it is envisioned, that this determination as to whether a fire is burning inside the protected room is made based upon a multitude of measured values of the characteristic fire value and/or based upon a multitude of different threshold values for the characteristic fire values measured inside the protected room. The failure safety of the system is thereby provided for. It would especially be conceivable for a fire to be reported first by the system when characteristic fire values are detected by multiple different sensors. It is further conceivable for the at least one characteristic fire value to be quantitatively measured, whereby the lowering of the oxygen concentration to the first and/or the second lowered level is implemented based upon said quantitative measured value for the characteristic fire value. Of course, the same applies to the lowering of the oxygen concentration to the full inertization level.

In this regard it is particularly preferred, that the at least one characteristic fire value is quantitatively measured, and that further the oxygen concentration is maintained at the first and/or the second lowered level for a period of time based upon the measured value and/or the measured values of the characteristic fire value(s). The inert gas extinguishing technique which is used can thus be very precisely adapted to the individual case. With this it is especially possible that, in the event of a fire, the quantity of inert gas to be additionally introduced into the protected room and used to fight the fire can be very precisely adapted to the extent and the nature of the fire.

In order to achieve, that with the inertization process of the invention the oxygen concentration can be maintained at the base inertization level, the first lowered level, the second lowered level and/or the full inertization level, it is preferred that inside the protected room, the oxygen concentration is measured, preferably continuously, whereby based upon the measured oxygen concentration, inert gas is introduced into the protected room in a controlled fashion. In addition or as an alternative to the controlled introduction of inert gas, however, it would also be conceivable for oxygen to be introduced, based upon the measured oxygen concentration, for example in the form of fresh air, in order to maintain the inertization level.

Of course it is also conceivable for the oxygen concentration inside the protected room not to be measured in order to enable the established inertization level to be maintained, rather for the concentration of the inert gas, such as nitrogen or carbon dioxide, contained inside the protected room to be detected with a corresponding detector. It would also be conceivable, in addition to measuring the oxygen level and/or the inert gas level, to determine the quantity of inert gas which must be introduced to maintain the established inertization level inside the protected room via an arithmetic calculation. Such a calculation should preferably be performed taking into account parameters that are specific to the protected room, such as the air exchange rate, etc.

BRIEF DESCRIPTION OF THE DRAWINGS

Below, a preferred embodiment of the process of the invention will be specified in greater detail with reference to the figures. The drawings show.

DETAILED DESCRIPTION OF THE PREFERRED EMBODIMENT

Figure 1A:
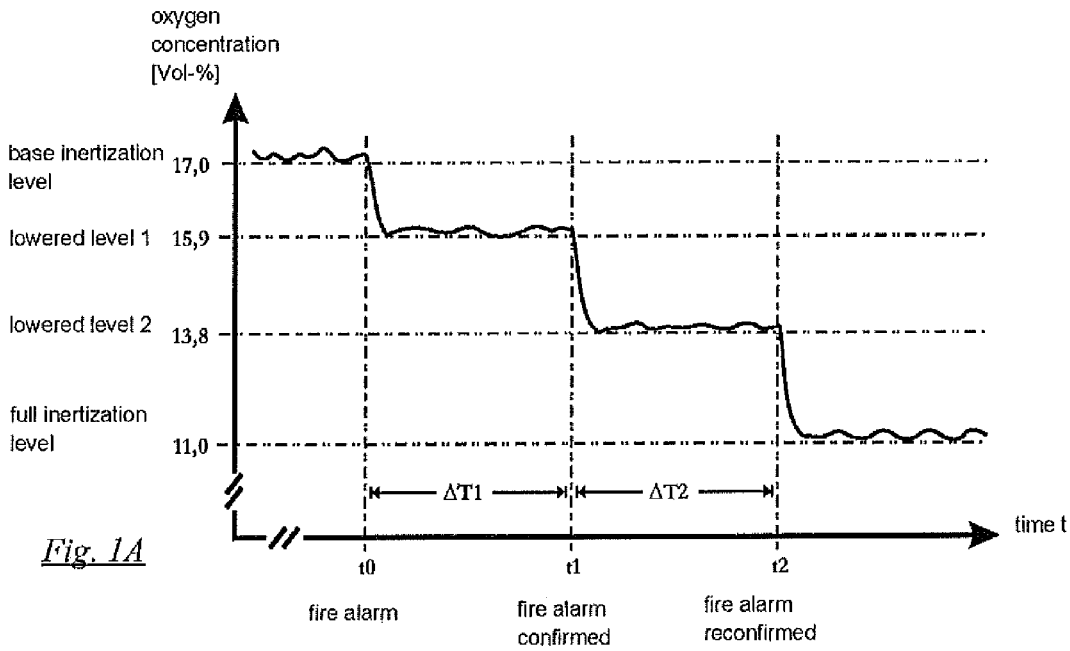
FIG. 1A illustrates the course over time of the oxygen concentration inside a protected room, when a preferred embodiment of the inertization process of the invention is used.
Figure 1B:
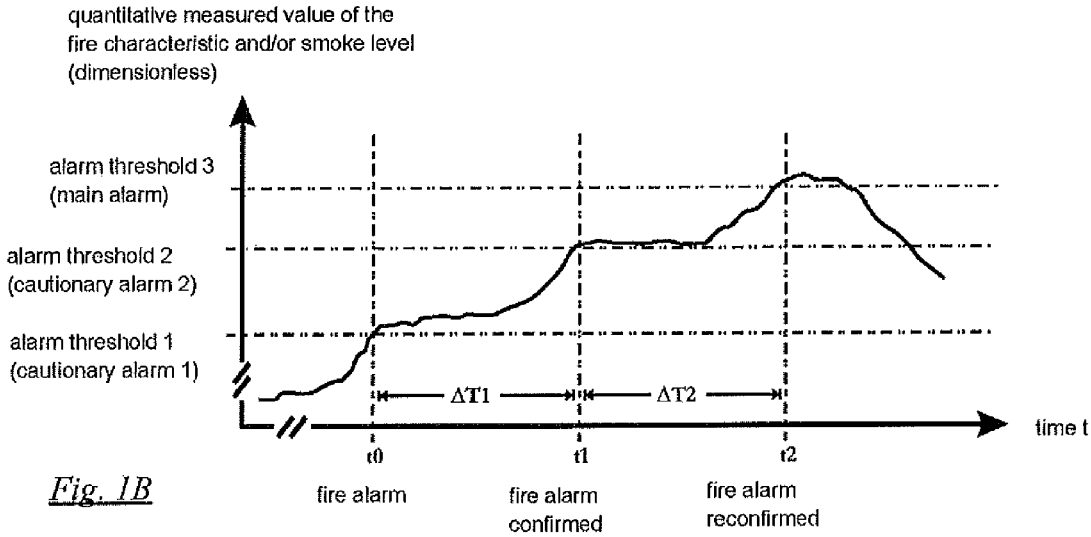
FIG. 1B illustrates the course over time of a quantitative measured value for the characteristic fire value and/or the smoke level inside the protected room, in which the oxygen concentration is lowered according to the curve shown in FIG. 1A, with the help of the preferred embodiment of the inertization process of the invention.

FIG. 1A and FIG. 1B each show the oxygen concentration and the quantitative measured value of the fire characteristic and/or the smoke level inside a protected room, in which a preferred embodiment of the inertization process of the invention is applied. In these, it is shown that at the time t0, the oxygen concentration is lowered to a base inertization level, where it is continuously maintained. The base inertization level in this preferred example corresponds to a concentration of 17.0 vol.-% oxygen in the air inside the monitored protected room.

The continuous maintenance of the oxygen concentration inside the protected room at the base inertization level up to time t0 is preferably accomplished via the continuous measurement of the oxygen concentration inside the protected room and via a controlled introduction of inert gas and/or fresh air into the protected room. As was mentioned above, the term "maintaining the oxygen concentration at a specific inertization level" refers herein to maintaining the oxygen concentration within a certain control range, in other words within a range that is defined by an upper and a lower threshold value. The maximum amplitude of the oxygen concentration within this control range can be established in advance and amounts, for example, to 0.1 to 0.4 vol.-%.

In the concentration sequences shown in the figures, the corresponding inertization level always represents the lower threshold value for the control range. Of course, this need not necessarily be the case. For example, it is also conceivable for the corresponding inertization level to represent the upper threshold value, and/or the medium range, in other words the value between the upper and the lower threshold range.

In the scenario represented in FIG. 1A, a fire alarm is emitted at the time t0 by a fire characteristic detector (not shown) to a control unit, which controls the execution of the inertization process of the invention on an inert gas system. Specifically, at this time t0, the smoke level and/or the quantitative measured value of the fire value, which is determined by the characteristic fire value detector, continuously or at preset time intervals, has exceeded a first threshold value (alarm threshold 1), as can be seen in FIG. 1B. As a reaction to this fire alarm, the oxygen concentration inside the protected room is reduced further from the base inertization level to the first lowered level. In the curve shown here, the first lowered level (lowered level 1) corresponds to an oxygen concentration of 15.9 vol.-%. As can be seen in the course over time in FIG. 1A, the lowering of the oxygen content to the first lowered level takes place within the shortest possible time. This is enabled by a rapid introduction of a quantity of inert gas which is determined in advance. Thus, shortly after the fire alarm is triggered, the oxygen concentration inside the protected room is lowered to lowered level 1.

The oxygen concentration is then maintained at this first lowered level for a first preset time ΔT1. At the same time, the quantitative value of the at least one fire characteristic in the air inside the protected room is determined continuously via the fire characteristic detector. In the scenario shown here, the quantitative value of the fire characteristic in the air inside the protected room increases steadily, despite the drop in the oxygen concentration to the first lowered level. This is an indication that, despite the reduced oxygen concentration, the fire inside the protected room has not been extinguished.

If, as is the case in the scenario shown in FIGS. 1A and 1B, when the first preset time ΔT1 has elapsed the quantitative measured value of the fire characteristic exceeds a second preset alarm threshold, it is assumed, that the fire has not yet been extinguished, so that the fire alarm triggered at the time t0 is again confirmed. The confirmation of the fire alarm at the time t1 causes the oxygen concentration inside the protected room to be rapidly lowered from the first lowered level (at the level of, for example, 15.9 vol.-% oxygen) to the second lowered level. This is accomplished again via the rapid introduction of a certain quantity of inert gas, so that, immediately following confirmation of the fire alarm at the time t1, the oxygen concentration reaches the second lowered level, at approximately 13.8 vol.-%.

At this second lowered level, the oxygen concentration inside the protected room is maintained for a second preset time ΔT2. This is again accomplished via the controlled subsequent introduction of inert gas and/or via the controlled introduction of fresh air.

However it can be assumed from the curve shown in FIG. 1B, that the repeated introduction of inert gas to establish the second lowered level has not resulted in a complete damping of the fire which has broken out inside the protected room. Although the quantitative measured value of the fire characteristic exhibits stagnation in this window of time ΔT2, meaning that the spreading of the fire inside the protected room has at least been successfully suppressed, after a certain time the smoke level and/or the quantitative measured value of the fire characteristic again rises, and even exceeds the alarm threshold 3, at which a main alarm is triggered. In the scenario shown in FIG. 1B, the alarm threshold 3 is exceeded already before the time t2.

When the second preset time ΔT2 has elapsed, in other words at the time t2, it is determined in the inertization process of the invention, whether the current quantitative measured value of the fire characteristic lies above the third alarm threshold (alarm threshold 3). If this is the case, as in FIG. 1B, for example, the fire alarm is confirmed, meaning that the fire that has broken out inside the protected room has not yet been extinguished, despite the reduction in the oxygen concentration to the second lowered level.

The reconfirmation of the fire alarm at the time t2 now causes the oxygen concentration inside the protected room to be further reduced from the second lowered level to the full inertization level, which is again accomplished via a rapid introduction of an appropriate quantity of inert gas. This appropriate quantity of inert gas can be determined in advance based upon the spatial parameters inside the protected room, such as the fire load and the size of the room, along with the density and the air exchange rate inside the room. It can be seen from the curve in FIG. 1A that, immediately following the time t2, in other words immediately following the reconfirmation of the fire alarm, the oxygen concentration has reached the full inertization level, which was determined in advance.

The full inertization level is configured, such that it corresponds to an oxygen concentration that lies below the ignition threshold for the materials present inside the protected room (fire load). By establishing the full inertization level inside the protected room, the fire is therefore completely extinguished by a removal of oxygen, while at the same time a re-ignition of the materials inside the protected room is effectively prevented.

It can be seen in the curve shown in FIG. 1B, that, after the full inertization level has been established (at time t2), the quantitative measured value of the fire characteristic continuously decreases, meaning, that the fire is being extinguished and/or has been extinguished. The full inertization level should be maintained at least until the temperature inside the protected room has dropped below the critical ignition threshold for the material. However, it would also be conceivable for the full inertization level to be maintained until forces have been reached and until the inert gas extinguishing system, which operates according to the inertization process of the invention, is taken out of its automatic fire extinguishing mode, for example via a manual release.

In the execution of the inertization process of the invention, as is shown by way of example in FIGS. 1A and 1B, the full inertization level is therefore established via two intermediate stages, namely the first and the second lowered level. In other words, this means that with the process of the invention, the quantity of inert gas required to effectively extinguish a fire is released only in partial quantities, so that decompression openings inside the protected room can be completely eliminated, or that decompression openings having significantly smaller dimensions need be provided inside the protected room.

Figure 2A:
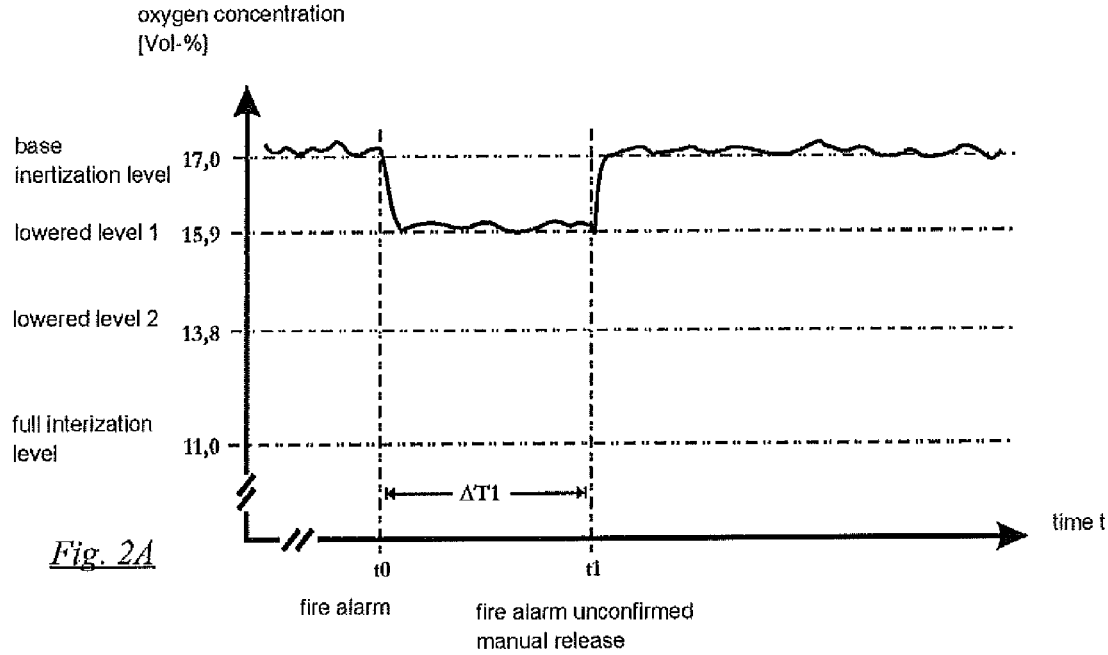
FIG. 2A illustrates the course over time of the oxygen concentration inside a protected room, with the execution of a preferred embodiment of the inertization process of the invention, whereby the fire is extinguished after the first preset time interval has elapsed.
Figure 2B:
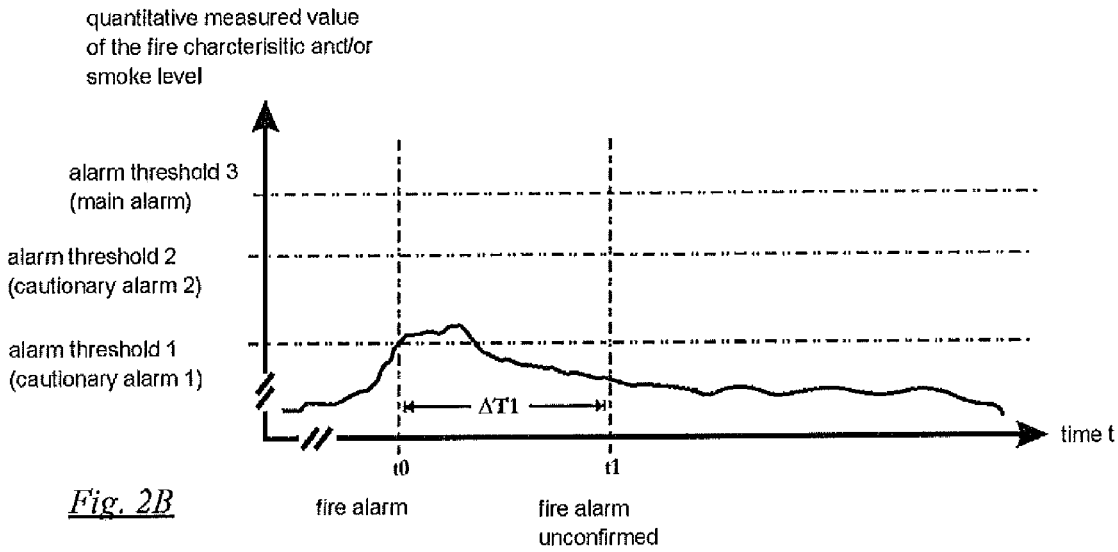
FIG. 2B illustrates the course over time of the quantitative measured value of the fire characteristic and/or the smoke level inside the protected room according to FIG. 2A.

In FIGS. 2A and 2B, a different scenario is shown, in which, when the first preset time ΔT1 has elapsed, the fire inside the protected room is already extinguished. As is illustrated especially in the curve in FIG. 2B, after the fire alarm has been triggered, at the time t0, the quantitative measured value of the fire characteristic first stagnates and then continuously decreases, which is an indication that the fire inside the protected room has been extinguished.

At the time t1, in other words when the first preset time ΔT1 has elapsed, the quantitative measured value of the fire characteristic (see FIG. 2B) thus lies below the first alarm threshold, so that at the time t1, the fire alarm is not confirmed. Because at the time t1 the fire alarm remains unconfirmed, the oxygen concentration inside the protected room can be raised back to the base inertization level, because the fire inside the protected room has been extinguished. This can be accomplished, for example, via the controlled introduction of fresh air.

In the inertization process of the present invention it is provided, that raising the oxygen concentration inside the protected room to the base inertization level, if the fire alarm is unconfirmed, can occur automatically, for example being initiated by the inertization system with which the inertization process according to the invention is implemented. Alternatively, however, it would also be conceivable for the oxygen concentration to be raised to the base inertization level, if the fire alarm is unconfirmed, only via a supplementary (independent) release. This independent supplementary release can, for example, be a manual release of forces. However, it would also be conceivable to use a parallel system which is completely autonomous in relation to the inertization system, in order to determine whether the fire detected inside the protected room at the time t0 has actually been extinguished, and whether a re-ignition of the fire can be ruled out.

Figure 3A:
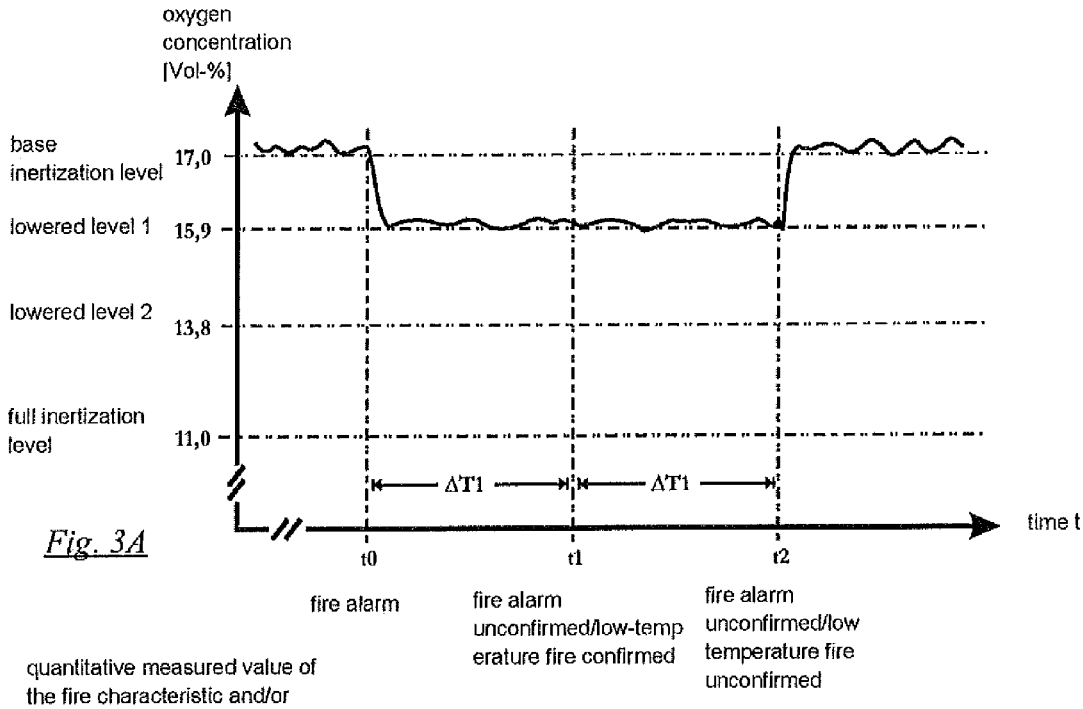
FIG. 3A illustrates the course over time of the oxygen concentration inside a protected room with the execution of a preferred embodiment of the inertization process of the invention, whereby the fire has not yet been fully extinguished by the time the first preset time interval has elapsed.
Figure 3B:
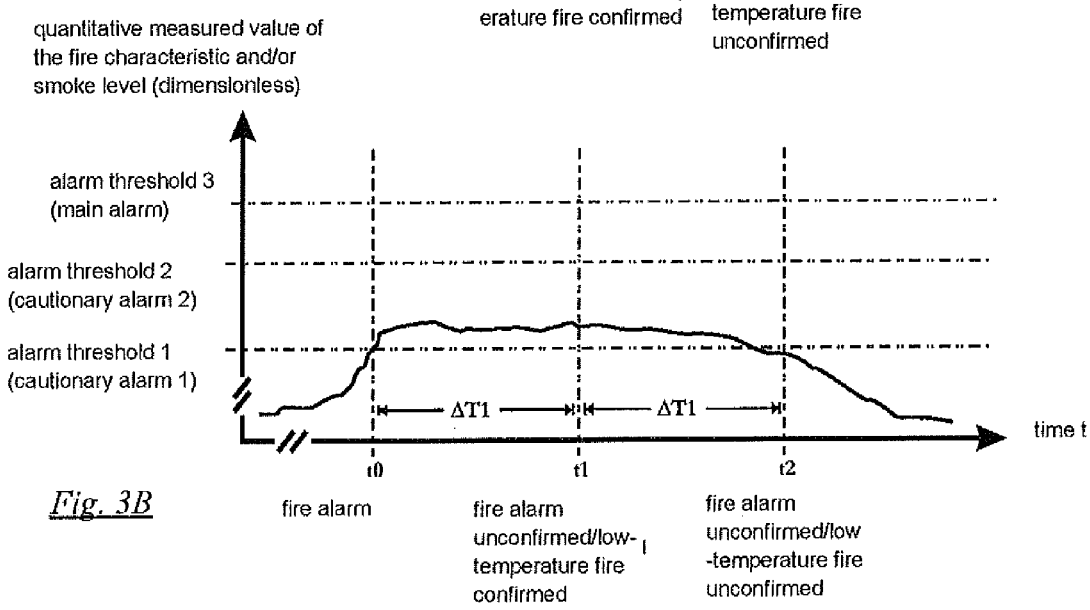
FIG. 3B illustrates the course over time of the quantitative measured value of the fire characteristic and/or the smoke level inside the protected room according to FIG. 3A.

In FIGS. 3A and 3B, a further scenario is represented, in which, after the decrease in the oxygen concentration inside the protected room to the first lowered level at the time t0 and after the oxygen concentration has been maintained at the first lowered level for the first preset time ΔT1, the fire that has broken out inside the protected room has not yet been extinguished, which is detected because the quantitative measured value of the fire characteristic does not continuously decrease within the window of time ΔT1, rather it stagnates or even increases slightly. In contrast to the previously described scenarios, however, this involves a fire that has been only partially extinguished and/or has transitioned into a low-temperature fire. The fire, however, is not large enough, that at the time t1, in other words when the first preset time ΔT1 has elapsed, the quantitative measured value of the fire characteristic has exceeded the second alarm threshold, which serves to confirm the fire alarm.

In this case, with the preferred embodiment of the inertization process of the invention, it is provided, that the first lowered level is again maintained for a first preset time ΔT1, in order then to be able to draw a conclusion, at time t2, regarding the fire status inside the protected room. If at time t2, in other words after the second elapse of the first preset time, the quantitative measured value of the fire characteristic continues to lie above the alarm threshold, it is provided in this represented embodiment, that the oxygen concentration is further reduced from the first lowered level to the second lowered level, as is shown in FIG. 3A.

However, it would also be conceivable for the first lowered level to again be maintained for an additional first preset time ΔT1, and for a decision regarding future measures to then be made.

As was already described above, the first and second preset times ΔT1 and ΔT2 are selected based upon the specific application. Furthermore, it is mentioned, that the oxygen concentrations, which in the represented exemplary embodiments correspond to the respective inertization level, are, of course, merely examples. It is further noted, that the decision criteria and the scenarios described above in relation to the first lowered level can naturally also be applied in a similar manner in connection with the second lowered level.

At this point it is mentioned, that, for example, the inertization system described in the German Patent Specification DE 198 11 851 C2 can be used to implement the inertization process according to the invention.

The process of the invention assumes the regular or continuous monitoring of the oxygen concentration and the fire characteristic content inside the target room. To this end, the oxygen concentration and/or the inert gas concentration and the quantitative value of the fire characteristic and/or the concentration of the smoke level inside the target room are regularly and/or continuously determined via corresponding sensors, and are fed to a control unit of an inert gas fire extinguishing system, which in response to this controls the supply of extinguishing agent and/or the supply of fresh air into the target room.

Although the process of the invention has been described in the preceding as having two intermediate stages (first and second lowered level), it is, of course, also possible for the process of the invention to have more than two intermediate stages, in order to enable an even better adaptation of the process to the protected room.

From the foregoing description, one ordinarily skilled in the art can easily ascertain the essential characteristics of this invention and, without departing from the spirit and scope thereof, can make various changes and modifications to the invention to adapt it to various usages and conditions.

In FIG. 1A

Sauerstoff Konzentration=Oxygen Concentration

Grundinertisierungs Niveau=Base Inertization Level

Absenkungsniveau 1=Lowered Level 1

Absenkungsniveau 2=Lowered Level 2

Vollinertisierungsniveau=Full Inertization Level

Feueralarm=Fire Alarm

Feueralarm bestätigt=Fire Alarm Confirmed

Feueralarm erneut bestätigt=Fire Alarm Reconfirmed

Zeit t=Time t

In FIG. 1B

Quantitativer Messwert der Brandkenngrösse bzw. Rauchpegel (dimensionslos)=Quantitative measured Value of the Fire Characteristic and/or Smoke Level (dimensionless)

Alarmschwelle 3 (Hauptalarm)=Alarm Threshold 3 (Main Alarm)

Alarmschwelle 2 (Voralarm 2)=Alarm Threshold 2 (Cautionary Alarm)

Alarmschwelle 1 (Voralarm 1)=Alarm Threshold 1 (Cautionary Alarm

Feueralarm=Fire Alarm

Feueralarm bestätigt=Fire Alarm Confirmed

Feueralarm erneut bestätigt=Fire Alarm Reconfirmed

Zeit t=Time t

In FIG. 2A

Sauerstoff Konzentration=Oxygen Concentration

Grundinertisierungs Niveau=Base Inertization Level

Absenkungsniveau 1=Lowered Level 1

Absenkungsniveau 2=Lowered Level 2

Vollinertisierungsniveau=Full Inertization Level

Feueralarm=Fire Alarm

Feueralarm unbestätigt manuelle Freigabe=Fire Alarm Unconfirmed, Manual Release

Zeit t=Time t

In FIG. 2B

Quantitativer Messwert der Brandkenngrösse bzw. Rauchpegel (dimensionslos)=Quantitative measured Value of the Fire Characteristic and/or Smoke Level (dimensionless)

Alarmschwelle 3 (Hauptalarm)=Alarm Threshold 3 (Main Alarm)

Alarmschwelle 2 (Voralarm 2)=Alarm Threshold 2 (Cautionary Alarm)

Alarmschwelle 1 (Voralarm 1)=Alarm Threshold 1 (Cautionary Alarm

Feueralarm=Fire Alarm

Feueralarm unbestätigt=Fire Alarm Unconfirmed

Zeit t=Time t

In FIG. 3A

Sauerstoff Konzentration=Oxygen Concentration

Grundinertisierungs Niveau=Base Inertization Level

Absenkungsniveau 1=Lowered Level 1

Absenkungsniveau 2=Lowered Level 2

Vollinertisierungsniveau=Full Inertization Level

Feueralarm=Fire Alarm

Feueralarm unbestätigt/Schwellbrand bestätigt=Fire

Alarm Unconfirmed/Low-Temperature Fire Confirmed

Feueralarm unbestätigt/Schwellbrand unbestätigt=Fire

Alarm Unconfirmed/Low-Temperature Fire Unconfirmed

Zeit t=Time t

In FIG. 3B

Quantitativer Messwert der Brandkenngrösse bzw. Rauchpegel (dimensionslos)=Quantitative measured Value of the Fire Characteristic and/or Smoke Level (dimensionless)

Alarmschwelle 3 (Hauptalarm)=Alarm Threshold 3 (Main Alarm)

Alarmschwelle 2 (Voralarm 2)=Alarm Threshold 2 (Cautionary Alarm)

Alarmschwelle 1 (Voralarm 1)=Alarm Threshold 1 (Cautionary Alarm)

Feueralarm=Fire Alarm

Feueralarm unbestätigt/Schwellbrand bestätigt=Fire Alarm Unconfirmed/Low-Temperature Fire Confirmed Feueralarm unbestätigt/Schwellbrand unbestätigt=Fire Alarm Unconfirmed/Low-Temperature Fire Unconfirmed Zeit t=Time t

What is claimed is:

1. An inertization process for reducing a risk of a fire and for extinguishing a fire in a protected room, the process comprising the steps of:

decreasing an oxygen concentration in the protected room to a desired base inertization level;

maintaining the oxygen concentration in the protected room at the base inertization level;

decreasing the oxygen concentration in the protected room from the base inertization level to a first lowered level in the event of a fire in the protected room;

maintaining the oxygen concentration in the protected room at the first lowered level for a first preset time interval; and decreasing the oxygen concentration in the protected room from the first lowered level to a full inertization level if a fire in the protected room has not been extinguished by the time the first preset time interval has elapsed.

2. The inertization process according to claim 1, further comprising the steps of:

decreasing the oxygen concentration in the protected room from the first lowered level to a second lowered level if the fire has not been extinguished by the time the first preset time interval has elapsed;

maintaining the oxygen concentration in the protected room at the second lowered level for a second preset time interval; and decreasing the oxygen concentration in the protected room from the second lowered level to the full inertization level if the fire has not been extinguished by the time the second preset time interval has elapsed.

3. The inertization process according to claim 2, wherein once one of the first and the second preset time intervals has elapsed, the oxygen concentration in the protected room is raised to the base inertization level if the fire in the protected room has been extinguished by the time the one of the first and second preset time interval has elapsed.

4. The inertization process according to claim 2, wherein once one of the first and the second preset time intervals has elapsed, the oxygen concentration in the protected room is manually raised to the base inertization level.

5. The inertization process according to claim 2, wherein the oxygen concentration at the second lowered level is selected based upon an extinguishing threshold of a fire load present in the protected room.

6. The inertization process according to claim 5, wherein the oxygen concentration at the second lowered level is lower than the oxygen concentration that corresponds to the extinguishing threshold of the fire load present in the protected room.

7. The inertization process according claim 2, wherein the oxygen concentration is measured in the protected room and is maintained at one of the base inertization level, the first lowered level, the second lowered level, and the full inertization level with at least one of a controlled supply of an inert gas, oxygen, and air.

8. The inertization process according to claim 2, further comprising the step of measuring multiple characteristic fire values in the protected room to determine what flammable material is burning in the protected room.

9. The inertization process according to claim 8, wherein at least one of the first and the second lowered level is selected based upon at least one of an ignition threshold and an extinguishing threshold of the determined flammable material.

10. The inertization process according to claim 8, wherein at least one of the characteristic fire values is quantitatively measured, and wherein the oxygen concentration in the protected room is decreased to at least one of the first lowered level, the second lowered level, and the full inertization level based upon the quantitatively measured characteristic fire value.

11. The inertization process according to claim 8, wherein at least one of the characteristic fire values is quantitatively measured, and wherein the oxygen concentration in the protected room is maintained at least one of the first lowered level and the second lowered level for a period of time based upon the quantitatively measured characteristic fire value.

12. The inertization process according to claim 1, further comprising the step of maintaining the full inertization level in the protected room at least until the fire in the protected room has been extinguished.

13. The inertization process according to claim 1, wherein once the first preset time interval has elapsed, the oxygen concentration in the protected room is raised to the base inertization level if the fire in the protected room has been extinguished by the time the first preset time interval has elapsed.

14. The inertization process according to claim 1, wherein the oxygen concentration at the first lowered level is selected based upon an ignition threshold of a fire load present in the protected room.

15. The inertization process according to claim 14, wherein the oxygen concentration at the first lowered level is substantially equal to the oxygen concentration that corresponds to the ignition threshold of the fire load present in the protected room.

16. The inertization process according to claim 1, further comprising the step of measuring at least one characteristic fire value in the protected room to determine whether a fire is burning in the protected room.

17. The inertization process according to claim 1, further comprising the steps of:

measuring a plurality of characteristic fire values in the protected room to determine whether a fire is burning in the protected room; and measuring a plurality of threshold values for the characteristic fire values measured in the protected room, wherein the determination whether a fire is burning in the protected room is based upon at least one of the measured levels of characteristic fire values and the threshold values for the characteristic fire values measured in the protected room.

18. An inertization process for reducing a risk of a fire and for extinguishing a fire in a protected room, the process comprising the steps of:

decreasing an oxygen concentration in the protected room to a desired base inertization level;

maintaining the oxygen concentration in the protected room at the base inertization level;

decreasing the oxygen concentration in the protected room from the base inertization level to a first lowered level in the event of a fire in the protected room;

maintaining the oxygen concentration in the protected room at the first lowered level for a first preset time interval; and decreasing the oxygen concentration in the protected room from the first lowered level to a second lowered level if the fire has not been extinguished by the time the first preset time interval has elapsed;

maintaining the oxygen concentration in the protected room at the second lowered level for a second preset time interval; and decreasing the oxygen concentration in the protected room from the second lowered level to a full inertization level if the fire has not been extinguished by the time the second preset time interval has elapsed.

19. The inertization process according claim 18, wherein the oxygen concentration is measured in the protected room and is maintained at one of the base inertization level, the first lowered level, the second lowered level, and the full inertization level with at least one of a controlled supply of an inert gas, oxygen, and air.

20. An inertization process for a protected room, the process comprising the steps of:

decreasing an oxygen concentration in the protected room to a desired base inertization level;

maintaining the oxygen concentration in the protected room at the base inertization level;

measuring at least one characteristic fire value in the protected room to determine at least one of whether a fire is burning in the protected room and what flammable material is burning in the protected room;

decreasing the oxygen concentration in the protected room from the base inertization level to a first lowered level in the event of a fire is burning in the protected room;

maintaining the oxygen concentration in the protected room at the first lowered level for a first preset time interval; and decreasing the oxygen concentration in the protected room from the first lowered level to a second lowered level if the fire has not been extinguished by the time the first preset time interval has elapsed;

maintaining the oxygen concentration in the protected room at the second lowered level for a second preset time interval; and decreasing the oxygen concentration in the protected room from the second lowered level to a full inertization level if the fire has not been extinguished by the time the second preset time interval has elapsed.

* * * * *